US005340333A

United States Patent [19]

Schroth

[11] Patent Number: 5,340,333

[45] Date of Patent: Aug. 23, 1994

[54] SHIELDED MODULAR ADAPTER

[75] Inventor: Walter D. Schroth, Chester Springs, Pa.

[73] Assignee: Interconnect Systems Group Inc., Exton, Pa.

[21] Appl. No.: 5,895

[22] Filed: Jan. 15, 1993

[51] Int. Cl.[5] ..... H01R 13/648

[52] U.S. Cl. ..... 439/607; 439/95; 439/638

[58] Field of Search ..... 439/95, 96, 97, 108, 439/92, 638, 654, 650, 676, 607, 609

[56] References Cited

U.S. PATENT DOCUMENTS

| | | | |
|---|---|---|---|
| 3,699,498 | 10/1972 | Haitmanek et al. | 439/248 |
| 3,850,497 | 11/1974 | Knemreich et al. | 439/545 |
| 3,860,316 | 1/1975 | Hardesky | 439/344 |
| 4,236,779 | 12/1980 | Tang | 439/638 |
| 4,387,949 | 6/1983 | Haitmanek | 439/95 |
| 4,392,701 | 7/1983 | Weidler | 439/638 |
| 4,408,819 | 10/1983 | Guelden | 439/638 |
| 4,424,403 | 1/1984 | Bogese, II | 174/36 |
| 4,618,196 | 10/1986 | Muzslay | 439/492 |
| 4,640,569 | 2/1987 | Dola et al. | 339/143 R |
| 4,732,568 | 3/1988 | Hall | 439/607 |
| 5,130,893 | 7/1992 | Straate et al. | 361/392 |

OTHER PUBLICATIONS

Cables to Go, Trade Literature for Modular Adapters, *Computer Shopper*, p. 330 (Mar., 1992).

National Computer Accessories, Trade Literature for RJ11 Modular Adapters, *Computer Shopper*, p. 450 (Mar., 1992).

AltexElectronics, Inc., Trade Literature for Modular Adapter Kits, *Computer Shopper*, p. 645 (Mar., 1992).

*Primary Examiner*—Gary F. Paumen
*Assistant Examiner*—Hien D. Vu
*Attorney, Agent, or Firm*—Synnestvedt & Lechner

[57] ABSTRACT

Modular adapters and similar devices are provided by this invention which minimize electrostatic interference and arcing. These devices include a pair of electrical connectors joined together with a series of electrical conductors. Each of the connectors is provided with a surrounding electromagnetic shield, and these shields are bridged together with a separate conductor element. During use, these devices can be used to releasably connect between a grounded cordset and an outlet serial port of a device or network.

19 Claims, 3 Drawing Sheets

SHIELDED MODULAR ADAPTER

FIELD OF THE INVENTION

This invention relates to minimizing distortion and noise in twisted-pair wiring networks, and more particularly, to providing specific shielding constructions for modular adapters.

BACKGROUND OF THE INVENTION

For many years, communications and word processing equipment, such as modems, multiplexers, terminals, computers, printers, and data PBXs have employed serial ports having a variety of connector types including D-subminiature construction for connecting to similarly configured connectors on the end of a relatively heavy gauge multi-conductor or coaxial cable. Recently, newer commercial building wiring standards, such as the EIA568 standard have been adopted by the Telecommunications Industry Association and the Electronics Industry Association (TIA/EIA), now require twisted-pair network systems.

Twisted-pair technology is therefore quickly challenging the traditional dominance of co-axial cabling in a wide range of computer and data communication applications, and has been established to be more flexible and less expensive than other wiring products. Twisted-pair cables are typically terminated with miniature modular plugs and jacks of the quick-connect-and-disconnect variety designed originally for use with telephone equipment. The combination of a multi-conductor cable terminated by one or more modular plugs is commonly referred to as a "cordset".

In order to satisfactorily achieve a connection between existing D-subminiature outlets on commercial communication and data processing equipment and these increasingly popular modular plugs of twisted-pair networks, modular adapters have been developed. These commercial adapters often include a D-subminiature male or female connector carefully wired to a RJ-jack.

Although modular adapters have bridged the technology gap between existing D-subminiature serial ports and twisted-pair networks, problems have arisen during high speed data processing. When processing speeds exceed about 10 megabytes/second, the incidence of electromagnetic interference and noise increases substantially in unshielded cables. In response, the art has employed extremely thin layers of conductive material bonded to the outer surface of the twisted-pair insulated wire to shield the transmission from electromagnetic and electrostatic charges. Such shielded cables are then terminated in a normal modular plug, resulting in a shielded cordset.

A shielded cordset is typically connected through one of the contact terminals of the modular plug to a source of ground potential external to the connection. This can be made by grounding the solder post end of one of the connections of the mating modular jack. This technique for grounding shielded cordsets unfortunately has been known to result in an "antenna-effect" caused by the passage of the high frequency signals along the lengthy grounded conductors. Additionally, electrostatic voltage created along the shielding may arc into adjacent signal conductors in looking for ground. This may result in unintended damage to expensive low voltage circuitry.

In an effort to overcome the short comings of narrow path, ground connections made to solder post ends, the art has also experimented with ground conductors extending outside the insulating housing of modular jacks, as disclosed in Hall, U.S. Pat. No. 4,732,568 ("the '568 patent"), which is hereby incorporated by reference. These ground conductors typically include a stamped metal casing having a surface area substantially greater than that of the ground spring contact, or other conductors within the modular connector. Typically, this ground conductor is terminated with a ring terminal, spade lug, or solder post.

Unfortunately, shielded, twisted-pair cabling looses its effectiveness when connected to an unshielded modular adapter. As yet, the art has not provided an adapter configuration which both meets the needs of standard modularity, while simultaneously providing a ground voltage to completely protect the wiring network from inductive and electrostatic effects.

SUMMARY OF THE INVENTION

This invention provides modular adapters and similar devices for providing complete grounded connections in system-to-device and device-to-device wiring applications. The adapters of this invention provide for releasably connecting, and shielding the transmission of electrical signals between a pair of connector elements. The adapter includes a first connector having a first group of electrical contacts and a first surrounding electromagnetic metallic shield. The adapter further includes a second connector having a second group of electrical contacts and a second surrounding electromagnetic shield. The first and second connectors are configured to mate with the connector elements to provide a complete circuit during use. Connected between the first and second connectors is a plurality of conductors, some of which join the contacts of the first and second group of contacts. At least one of these conductors, however, is electrically connected between the first and second electromagnetic metallic shields to provide a reference voltage or ground when the adapter is used to assist in the transmission of electrical signals between the connector elements.

Accordingly, the adapters of this invention are capable of providing a ground for the complete adapter system without the loss of compact size or standard modularity. The preferred adapters of this invention can be used in all types of RJ and D-subminiature connector systems typically used in communications and data processing equipment, but are not limited to these types of connectors, since they can be modified for use in any grounded cable systems. These adapters can also be fabricated in multi-position, preconfigured units and in complete self-contained kits.

In alternative versions of this invention, the conductors connecting the first and second adapter connectors can include free-standing wires, or alternatively, the conductor paths of a printed circuit board. Several of the disclosed modular connectors of this invention can be mounted to a printed circuit board and connected through conductor paths on the board to a series of D-subminiature, or a few large capacity Telco connectors, or the like. Such patch panels and distribution can be used to convert, for example, a 25-pair trunk cabling into groups of modular RJ 45 jacks. Each jack would then represent a port which can be numbered to correspond to an assigned voice/data switch or multiplexer. As can be observed by these examples, the fundamental shielding principals of this invention can be carried forth into a myriad of other wiring products.

BRIEF DESCRIPTION OF THE DRAWINGS

The accompanying drawings illustrate preferred embodiments of the invention, as well as other information pertinent to the disclosure, in which.

DETAILED DESCRIPTION OF THE INVENTION

This invention provides shielded modular adapters and like devices for use in connection with twisted-pair wiring networks. The modular adapters of this invention are exceptionally useful in minimizing noise in high speed data processing applications. As used herein, the term "modular" refers to the quick-connect-and-disconnect jacks and plugs developed by Western Electric Company and Bell Telephone Laboratories for use with telephone equipment, as disclosed in U.S. Pat. Nos. 3,699,498; 3,850,497; and 3,860,316, which are hereby incorporated by reference. The term "D-subminiature" refers to the D-shaped connectors often used as outlet ports and connection cables for modem, multiplexers, terminals, printers, and PBX-systems. One preferred modular connector system is the RJ-type system which includes sizes such as RJ-11, RJ-12, RJ-45, etc. This invention is also useful in connection with custom adapters, containing, for example, up to 64 pin capacity, co-axial-to-modular adapters, in-line modular connectors and adapters, data cables, and gender changers. Both male and female connectors can be used interchangeably on either side of the devices of this invention as the application may require.

Figure 2:
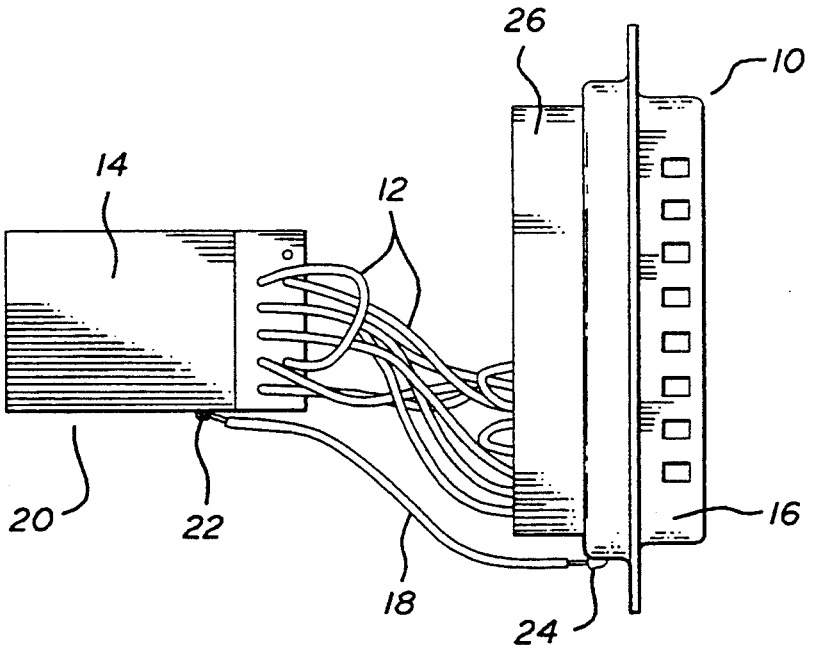
FIG. 2: is a top plan view of the preferred modular adapter of this invention without the protective shell.
Figure 3:
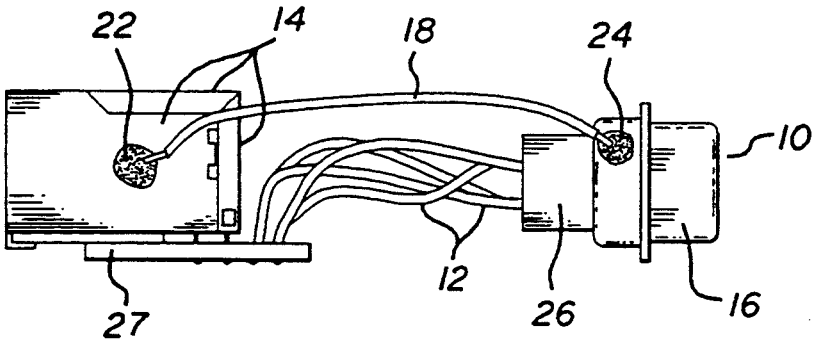
FIG. 3: is a side view of the preferred modular adapter of FIG. 2.
Figure 4:
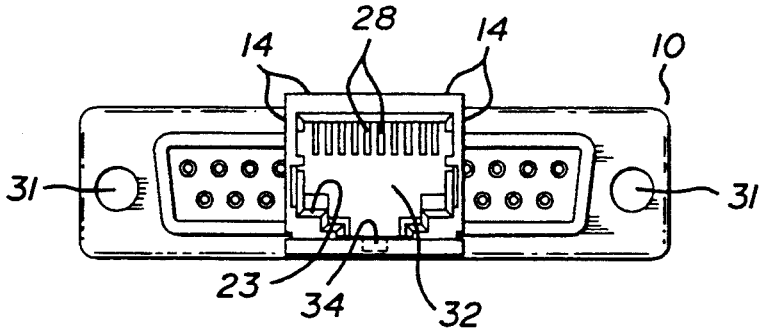
FIG. 4: is an end view of the modular adapter of FIG. 2, illustrating the modular jack.

With reference to the Figures, and particularly to FIGS. 1–5 thereof, there is shown a preferred shielded modular adapter 100. The preferred adapter 100 includes a RJ-modular jack 20 on a first end and a D-subminiature connector 10 on a second end thereof. The modular jack 20 preferably includes a plug-receiving cavity 32 and a plurality of side-by-side spring contacts 28 disposed within the cavity 32. The spring contacts can be of various constructions, including flying leads or spring contacts which present a flat contact surface, such as those disclosed in the '568 patent. The spring contacts 28 should be resilient and arranged to engage with similarly-spaced contact terminals of a suitable modular plug of the type typically used with such RJ-modular jacks. The spring contacts can number from about 2 to about 12 wires and preferably include at least one ground or reference voltage contact therein. Additionally, a suitable locking tab recess 34 can be provided for mating to a locking tab of a modular plug. The spring contacts are retained in and through a surrounding dielectric housing 23. This dielectric housing 23 preferably is configured to provide the insulation barrier between the electrical connections within the RJ-modular jack as shown in FIG. 4.

The metal shield 14 of the preferred RJ-modular jack 20 of this invention is preferably of the type commercially available through Stewart Connector Systems, Inc. Such shields are typically constructed of one or more stamped metal pieces which may take any number of forms. In the preferred embodiment, the metal shield 14 is disposed substantially around the dielectric housing 23, as shown in FIGS. 2–4, and preferably includes an integral connection to one of the spring contacts 28 or other conductor located within the plug-receiving cavity 32 that is electrically connected with the shield conductor of a shielded cordset, or the like, as described below.

This invention is ideally used in connection with shielded cables, such as that disclosed in U.S. Pat. No. 4,424,403, which is also incorporated herein by reference. These cables are often terminated by a modular plug having a free end for insertion into the plug-receiving cavity 32 of the RJ-modular jack 20. Upon insertion, the locking tab of the plug mates with the locking tab recess 34 configured within the modular jack dielectric housing 23. The contact terminals of the plug then engage the spring contacts 28 which are flexed upwardly together. When the plug is fully inserted, the lower surfaces of the spring contacts 28 meet with the upper surfaces of the contact terminals of the plug to provide a low impedance electrical connection.

In the preferred embodiment, one of the normal spring contacts in the RJ-modular jack 20 is replaced with a ground conductor, or an additional conductor is provided for grounding, which is then connected to the metal shield 14 external to the plug-receiving cavity, as substantially shown and described, for example, in the '568 patent.

Figure 1:
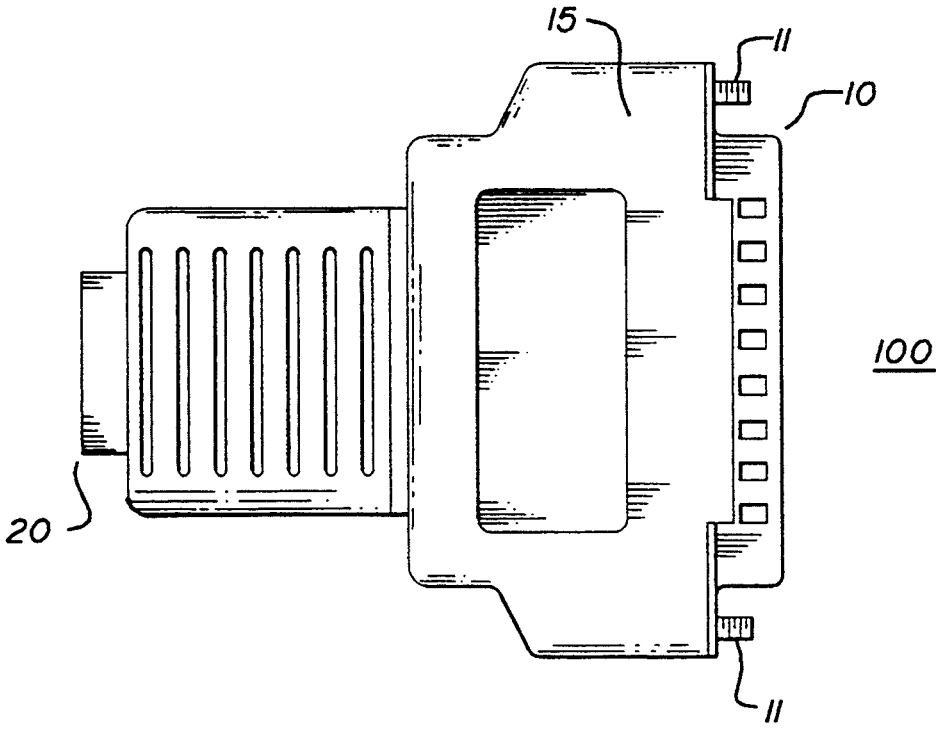
FIG. 1: is a top plan view of a preferred modular adapter of this invention incorporated within a protective polymeric shell.
Figure 5:
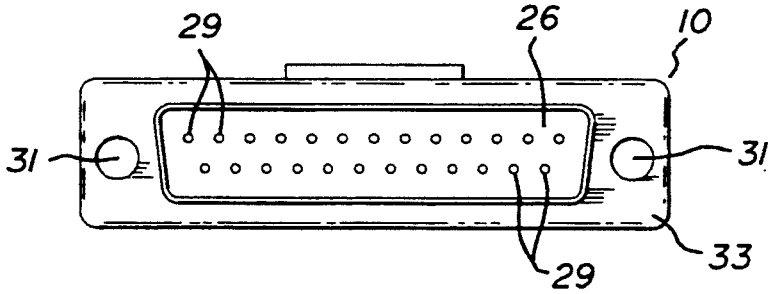
FIG. 5: is an end view of the modular adapter of FIG. 2, illustrating the D-subminiature connector.

As shown in FIGS. 2 and 5, the opposing end of the shielded modular adapter 100 preferably includes a D-subminiature connector 10. The D-subminiature connector can be male or female, but preferably includes a male connector containing a plurality of contact pins 29, numbering about 9–25, uniformly distributed through a D-subminiature dielectric housing 26 as shown in FIG. 5. Surrounding the dielectric housing 26 is a preferred metal shield 16, which also can be made of a stamped metal construction. The metal shield can be provided with a surrounding flange 33 having holes 31 therethrough for receiving mounting screws 11, such as those described in FIG. 1.

In an important aspect of the shielded modular adapter 100, a ground wire 18 is provided between the metal shield 14 of the RJ-modular jack 20 and the metal shield 16 of the D-subminiature connector 10. As shown in FIG. 3, the ground wire 18 can be suitably soldered with solder joints 22 and 24 to make these electrical connections. In this way, the ground path between the metal shields 14 and 16 can be made through the adapter. The balance of the signal wires 12 can thereafter be joined between contact terminals on a printed circuit board 27 connected to the solder posts of the RJ-modular jack 20, and the contact pins 29 of the D-subminiature connector 10. As shown in FIG. 1, the ground wire 18 and the signal wires 12 can thereafter be encapsulated and protected in a tough, insulating, polymeric connector shell 15.

Figure 6:
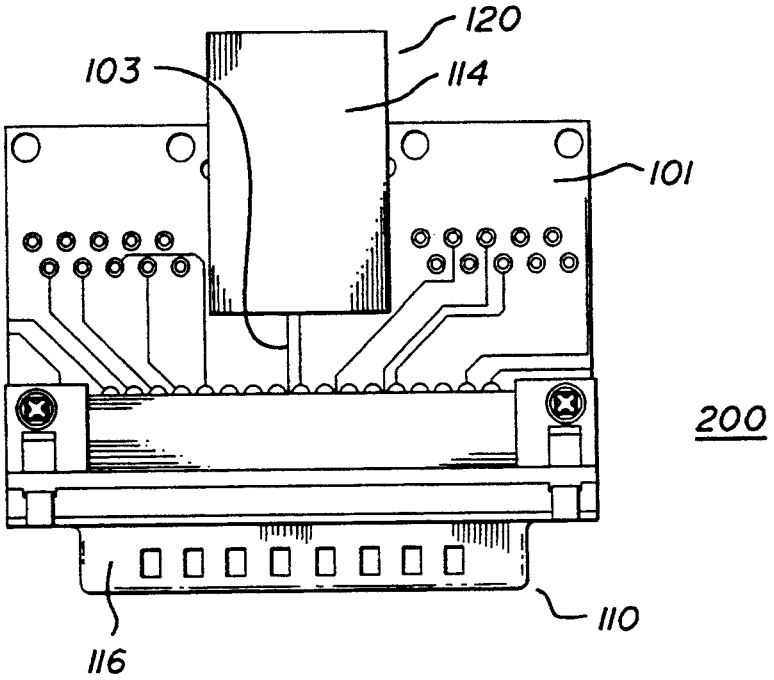
FIG. 6: is a top plan view of a printed circuit board embodiment of the adapter of this invention.
Figure 7:
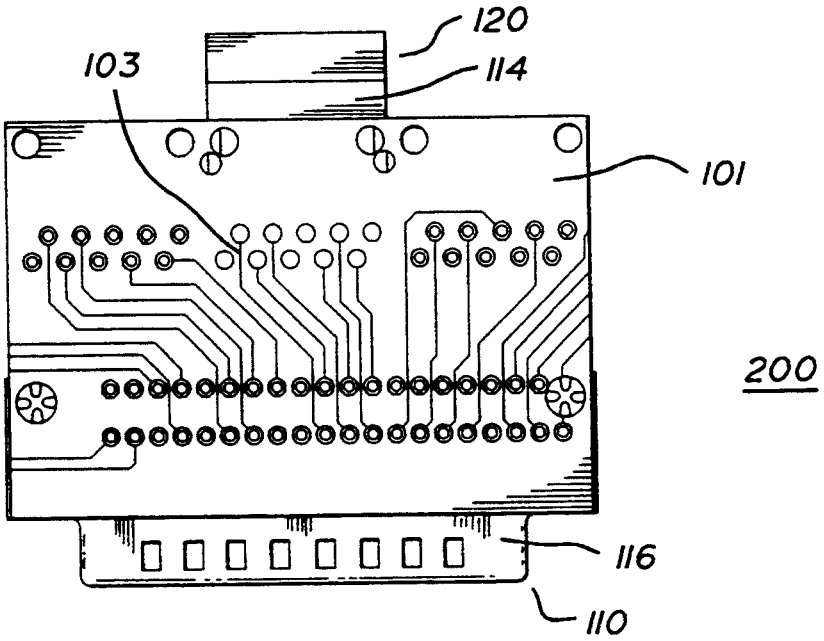
FIG. 7: is a bottom plan view of the printed circuit board embodiment of FIG. 6.

In an alternative preferred embodiment described in FIGS. 6 and 7, a printed circuit board-based, shielded modular adapter 200 is provided. This embodiment also preferably includes a RJ-modular jack of the type provided by the '568 patent, which is mounted, preferably by soldering its posts, to a printed circuit board 101. A D-subminiature connector 110 can be fastened to one end of the printed circuit board 101 by connecting screws, or the like. The features of the D-subminiature connector 110 and RJ-modular jack 120 are substantially similar to those for the adapter 100 described above. For example, both of the connectors of this embodiment include metal shields 14 and 16 for providing a ground path or reference voltage to insulate the connections from electromagnetic and electrostatic interference. In substantial departure from the shielded modular adapter 100, however, the connections between these connector elements are made substantially by connector paths on the printed circuit board 101. In this way, the tangled web of signal wires 12, as shown in FIGS. 2 and 3, can be avoided, and the manufacturing cost can be reduced considerably while often simultaneously improving the electrical integrity of the connecting elements.

As shown in FIG. 7, the ground path 103, or reference voltage, can be provided by one of the conductive circuit paths along the printed circuit board 101. In this way, the solder posts of the D-subminiature connector 110 and RJ-modular jack 120 can be wave soldered directly to the printed circuit board 101 to not only provide the signal conducting paths, but also the ground path for providing complete shielding through the adapter.

The principals of this invention can also be applied to signal distribution systems and patch panels of the type used in audio, video, telephone, and data communications applications. Such systems can include multiple shielded RJ-male or female connections mounted to a printed circuit board and grounded to one or more multi-pin connectors. One application, for example, includes a high-speed information outlet for the distribution of voice and data communications. Another application could be a modular patch panel that typically addresses data transmission requirements of the TIA/EIA-568 commercial building wiring standard. These patch panels include, for example, RJ-45 modular female connector arrays that provide 4 to 12-position RJ plug connectors. Such panels are useful in simplifying the cross-connections for both data and voice circuits.

From the foregoing, it can be realized that this invention provides shielded modular adapters and other equipment which are capable of minimizing electrostatic interference and arcing. Although various embodiments have been illustrated, this was for the purpose of describing, and not limiting the invention. Various modifications, which will become apparent to one skilled in the art, are within the scope of this invention described in the attached claims.

What is claimed is:

1. A modular adapter for coupling a modular plug to a D-subminiature serial port, comprising:

a modular jack including a plug-receiving cavity and a plurality of side-by-side spring contacts disposed therein for engaging with similarly spaced contact terminals of said modular plug, said modular jack comprising a first surrounding stamped metal electromagnetic shield;

a D-subminiature connector having a plurality of contact pins disposed therein for engaging with similarly spaced contact sleeves of said D-subminiature serial port, said D-subminiature connector comprising a second surrounding stamped metal electromagnetic shield; and a plurality of conductor wire means joining at least a portion of said contact pins with said spring contacts, at least one of said conductor wire means being electrically connected with said first and second electromagnetic shields to provide a reference voltage or ground during the use of said modular adapter.

2. The modular adapter of claim 1, wherein said modular jack comprises a RJ-type socket having a dielectric housing.

3. The modular adapter of claim 2, wherein said first surrounding stamped metal electromagnetic shield is disposed substantially around said dielectric housing and connected through said housing to one of said spring contacts.

4. The modular adapter of claim 1, wherein said D-subminiature connector includes a dielectric housing having a D-shaped cross-section and a plurality of substantially parallel through-holes for containing said contact pins.

5. The modular adapter of claim 2, wherein said modular jack comprises a locking tab recess for receiving a locking tab of said modular plug.

6. The modular adapter of claim 5, wherein said spring contacts comprise about 2–12 spring connector wires.

7. The modular adapter of claim 1, wherein said stamped metal shield of said first surrounding electromagnetic shield is grounded through said modular plug to a shield conductor of a multi-conductor shielded cable.

8. An electrical apparatus for releasably connecting and shielding the transmission of electrical signals between a pair of connector elements, comprising:

a first apparatus connector having a first group of electrical contacts disposed therein and a first surrounding electromagnetic metallic stamped metal shield;

a second apparatus connector having a second group of electrical contacts therein and a second surrounding electromagnetic shield, said first and second apparatus connectors being configured to mate with said connector elements; and a plurality of conductor wires joined between at least a portion of said contacts of said first and second groups of contacts, at least one of said conductor wires being connected between said first and second electromagnetic metallic shields to provide a reference voltage or ground when said apparatus is used to assist in the transmission of electrical signals between said connector elements.

9. The electrical apparatus of claim 8, wherein said first and second apparatus connectors and said plurality of conductor wires are disposed substantially within a polymeric connector shell.

10. The electrical apparatus of claim 9, wherein said first apparatus connector comprises a RJ-type modular female jack connector and said second apparatus connector comprises a D-subminiature connector.

11. The electrical apparatus of claim 9, wherein said one of said conductor wires comprises a conductor path of a printed circuit board.

12. The electrical apparatus of claim 9, wherein said one of said conductor wires comprises a discrete wire.

13. The electrical apparatus of claim 9, wherein said first apparatus connector comprises a telephone-type modular jack having a plurality of spring contacts therein, and said first surrounding electromagnetic shield is electrically connected with one of said spring contacts to provide a ground or reference voltage conducting path to a shield of a multi-conductor cable upon connecting with a shielded cordset.

14. The electrical connecting apparatus of claim 13, wherein said second connector comprises a D-subminiature male connector having a plurality of pins disposed therein.

15. A modular adapter comprising a shielded RJ-type modular jack wired to a shielded D-subminiature connector with a plurality of conductor wires, at least one of said conductor wires being soldered between said shielding of said modular jack and said shielding of said D-subminiature connector for providing a ground or reference voltage when said adapter is connected between a pair of circuit elements; and a polymeric connector cover disposed at least around said conductor wires.

16. The modular adapter of claim 5, wherein said shielded RJ-type modular jack comprises a plurality of spring contacts for providing electrical connection to a plurality of RJ-type male plugs having 2–12 connector terminals thereon.

17. A method of releasably connecting and shielding a transmission of electrical signals between a pair of dissimilarly configured connector elements, comprising:

providing an electrical adapter having a first adapter connector including a first group of electrical contacts disposed therein and a first surrounding electromagnetic metallic shield, a second adapter connector having a second group of electrical contacts therein and a second surrounding electromagnetic stamped metal shield, said first and second adapter connectors being configured to mate with said dissimilarly configured connector elements, a plurality of conductor wires joined between at least a portion of said contacts of said first and second group of contacts, at least one of said conductor wires being connected between said first and second electromagnetic metallic shields;

mating said first and second adapter connectors with a corresponding connector element; and transmitting an electrical signal between said connector elements whereby said electrical signal is at least partially shielded by said first and second surrounding electromagnetic shields.

18. The method of claim 17, wherein said first and second electromagnetic metallic shields also minimize electrostatic voltage arcing.

19. The method of claim 17, wherein said first adapter connector comprises a RJ-type modular connector and said second adapter connector comprises a D-subminiature connector.

* * * * *

UNITED STATES PATENT AND TRADEMARK OFFICE

CERTIFICATE OF CORRECTION

PATENT NO. : 5,340,333

DATED : August 23, 1994

INVENTOR(S) : Walter D. Schroth

It is certified that error appears in the above-identified patent and that said Letters Patent is hereby corrected as shown below:

Col. 7, line 25 (Claim 16, line 1), change "claim 5" to --claim 15--

Signed and Sealed this

Eighteenth Day of October, 1994

*Attest:*

Bruce Lehman

BRUCE LEHMAN

*Attesting Officer*

*Commissioner of Patents and Trademarks*